US010113467B2

(12) United States Patent
Murakami

(10) Patent No.: US 10,113,467 B2
(45) Date of Patent: Oct. 30, 2018

(54) CATALYST STORAGE CASE, EXHAUST DUCT, AND ENGINE

(71) Applicant: Yanmar Co., Ltd., Osaka-shi, Osaka (JP)

(72) Inventor: Ryuichiro Murakami, Osaka (JP)

(73) Assignee: Yanmar Co., Ltd., Osaka-shi (JP)

( * ) Notice: Subject to any disclaimer, the term of this patent is extended or adjusted under 35 U.S.C. 154(b) by 41 days.

(21) Appl. No.: 15/115,395

(22) PCT Filed: Jan. 8, 2015

(86) PCT No.: PCT/JP2015/050326
§ 371 (c)(1),
(2) Date: Jul. 29, 2016

(87) PCT Pub. No.: WO2015/115144
PCT Pub. Date: Aug. 6, 2015

(65) Prior Publication Data

US 2017/0002712 A1 Jan. 5, 2017

(30) Foreign Application Priority Data

Jan. 31, 2014 (JP) ..... 2014-017533

(51) Int. Cl.
*F01N 3/28* (2006.01)
*F01N 13/00* (2010.01)
*F01N 3/10* (2006.01)

(52) U.S. Cl.
CPC ..... *F01N 3/2882* (2013.01); *F01N 3/103* (2013.01); *F01N 3/28* (2013.01); *F01N 3/2885* (2013.01);
(Continued)

(58) Field of Classification Search
CPC ..... F01N 3/2882; F01N 3/103; F01N 3/28; F01N 3/2885; F01N 3/2892; F01N 13/017; F01N 2230/04; F01N 2330/02; F01N 1/00; F01N 13/00; F01N 3/00; F01N 3/10; F01N 3/24
(Continued)

(56) References Cited

U.S. PATENT DOCUMENTS 4,884,398 A 12/1989 Morita et al.
5,578,277 A * 11/1996 White ..... F01N 1/083 422/171

FOREIGN PATENT DOCUMENTS

EP 1 059 427 A1 12/2000
EP 1059427 A1 * 12/2000 ..... F01N 3/28
(Continued)

OTHER PUBLICATIONS

International Search Report (PCT/ISA/210) issued in PCT Application No. PCT/JP2015/050326 dated Mar. 24, 2015 with English translation (five pages).
(Continued)

*Primary Examiner* — Laert Dounis
*Assistant Examiner* — Kelsey Stanek
(74) *Attorney, Agent, or Firm* — Norton Rose Fulbright US LLP

(57) ABSTRACT

A catalyst storage case includes a case body having an exhaust passage; and first and second oxidation catalysts disposed in the exhaust passage of the case body. The first and second oxidation catalysts are arrayed in a direction intersecting a direction along which the exhaust passage extends.

2 Claims, 9 Drawing Sheets

(52) U.S. Cl.
CPC ..... *F01N 3/2892* (2013.01); *F01N 13/017* (2014.06); *F01N 2230/04* (2013.01); *F01N 2330/02* (2013.01)

(58) Field of Classification Search
USPC ..... 60/301
See application file for complete search history.

(56) References Cited

FOREIGN PATENT DOCUMENTS

| | | | |
|---|---|---|---|
| JP | 64-12015 | A | 1/1989 |
| JP | 1-106916 | A | 4/1989 |
| JP | 1-106917 | A | 4/1989 |
| JP | 6-8722 | U | 2/1994 |
| JP | 2003-214142 | A | 7/2003 |
| JP | 2003-214143 | A | 7/2003 |
| JP | 2008-190505 | A | 8/2008 |
| JP | 8-14033 | A | 12/2013 |
| JP | 2013-241860 | A | 12/2013 |
| WO | WO 2015/015619 | A1 | 2/2015 |

OTHER PUBLICATIONS

Japanese-language Written Opinion (PCT/ISA/237) issued in PCT Application No. PCT/JP2015/050326 dated Mar. 24, 2015 (five pages).

International Preliminary Report on Patentability (PCT/IB/326, PCT/IB/338 & PCT/IB/373) issued in PCT Application No. PCT/JP2015/050326 dated Aug. 11, 2016, including English translation of document C2 (Japanese-language Written Opinion (PCT/ISA/237)) previously filed on Jul. 29, 2016 (nine pages).

European Search Report issued in counterpart European Application No. 15742981.2 dated Aug. 2, 2017 (eight pages).

* cited by examiner

CATALYST STORAGE CASE, EXHAUST DUCT, AND ENGINE

TECHNICAL FIELD

The present disclosure relates to a catalyst storage case, an exhaust duct, and an engine.

BACKGROUND

A conventional engine is described for example in JP-A-2013-241860 (Patent Document 1). This engine includes a cylinder body having a combustion chamber; an exhaust pipe communicating with an exhaust port of the combustion chamber; and an oxidation catalyst filled in the exhaust pipe. The oxidation catalyst oxidizes oxidizable components contained in exhaust gas discharged from the combustion chamber.

PRIOR ART DOCUMENT

Patent Document

Patent Document 1: JP-A-2013-241860

SUMMARY

Problem to be Solved by the Disclosure

In the conventional engine, however, since a single oxidation catalyst is filled in the exhaust pipe, if the exhaust gas flow becomes uneven within the exhaust pipe, the single oxidation catalyst may possibly be partially, not wholly, subjected to clogging. For this reason, the performance of the oxidation catalyst decreases in a short period of time, resulting in a necessity to replace this oxidation catalyst in spite of the presence of unclogged portions in the single oxidation catalyst, which is wasteful.

It is therefore an object of the present disclosure to provide a catalyst storage case, an exhaust duct, and an engine, capable of reducing the waste of the oxidation catalyst when replacing the oxidation catalyst.

Solution to the Problems

In order to solve the problem, a catalyst storage case of the present disclosure includes: a case body having an inlet, an outlet, and an exhaust passage extending from the inlet to the outlet for allowing exhaust gas to pass therethrough; and a plurality of oxidation catalysts disposed in the exhaust passage of the case body, the plurality of oxidation catalysts are arrayed in a direction intersecting a direction along which the exhaust passage extends.

According to the catalyst storage case of the present disclosure, a plurality of oxidation catalysts are contained and are arrayed in a direction intersecting the direction along which the exhaust passage extends. As a result, even though the flow of exhaust gas becomes uneven within the case body, at least one of the plurality of oxidation catalysts experience clogging. Hence, only the clogged oxidation catalyst may be replaced and the unclogged first oxidation catalyst may be used intactly, thus enabling the waste of the oxidation catalysts to be reduced.

The catalyst storage case of one embodiment includes a baffle plate disposed between the oxidation catalysts and the inlet in the exhaust passage of the case body, for leading exhaust gas to each of the oxidation catalysts.

According to the catalyst storage case of this embodiment, since the baffle plate leads exhaust gas to each of the oxidation catalysts, it can substantially uniformly lead exhaust gas to each of the oxidation catalysts so that unevenness of occurrence of clogging in the first and second oxidation catalysts can be reduced.

An exhaust duct of one embodiment includes: the catalyst storage case; and an exhaust muffler communicating with the outlet of the catalyst storage case, the catalyst storage case and the exhaust muffler are integrally connected together.

According to the exhaust duct of this embodiment, the catalyst storage case and the exhaust muffler are integrally connected to each other, so that the number of components of the exhaust duct can be reduced, facilitating the assembly of the exhaust duct.

An engine of one embodiment includes: a cylinder block having a cylinder; a cylinder head attached to the cylinder block, the cylinder head having an exhaust port communicating with the interior of the cylinder; and the catalyst storage case attached to the cylinder head, the inlet of the catalyst storage case is in communication with the exhaust port of the cylinder head.

According to the engine of this embodiment, due to including the catalyst storage case having the plurality of oxidation catalysts, even though the oxidation catalysts are subjected to clogging by exhaust gas as a result of the operation of the engine, the waste of the oxidation catalysts can be reduced when replacing the oxidation catalysts.

In the engine of this embodiment, the cylinder block has a piston disposed in the cylinder and a crankshaft coupled to the piston; the cylinder block has a load-side end face from which a load-side end of the crankshaft protrudes; the catalyst storage case is disposed toward the load-side end face of the cylinder block; and the plurality of oxidation catalysts in the catalyst storage case are arrayed in a direction intersecting a shaft center of the crankshaft.

As used herein, the load-side end of the crankshaft refers to an end to which a load member (such as a fluid pressure pump or a pulley) is connected.

According to the engine of this embodiment, since the plurality of oxidation catalysts are arrayed in a direction intersecting the shaft center of the crankshaft, the thickness of the catalyst storage case in the direction of the shaft center of the crankshaft can be suppressed regardless of the presence of the plurality of oxidation catalysts. Therefore, the catalyst storage case can be restrained from protruding toward the load of the cylinder block, preventing the catalyst storage case from interfering with the load member when connecting the load member to the load-side end of the crankshaft of the cylinder block.

Effect of the Disclosure

According to the catalyst storage case of the present disclosure, a plurality of oxidation catalysts are contained and are arrayed in a direction intersecting the direction along which the exhaust passage extends, whereby the waste of the oxidation catalysts can be reduced when replacing the oxidation catalysts.

DETAILED DESCRIPTION

The present disclosure will now be described in detail with reference to shown embodiments.

First Embodiment

Figure 1:
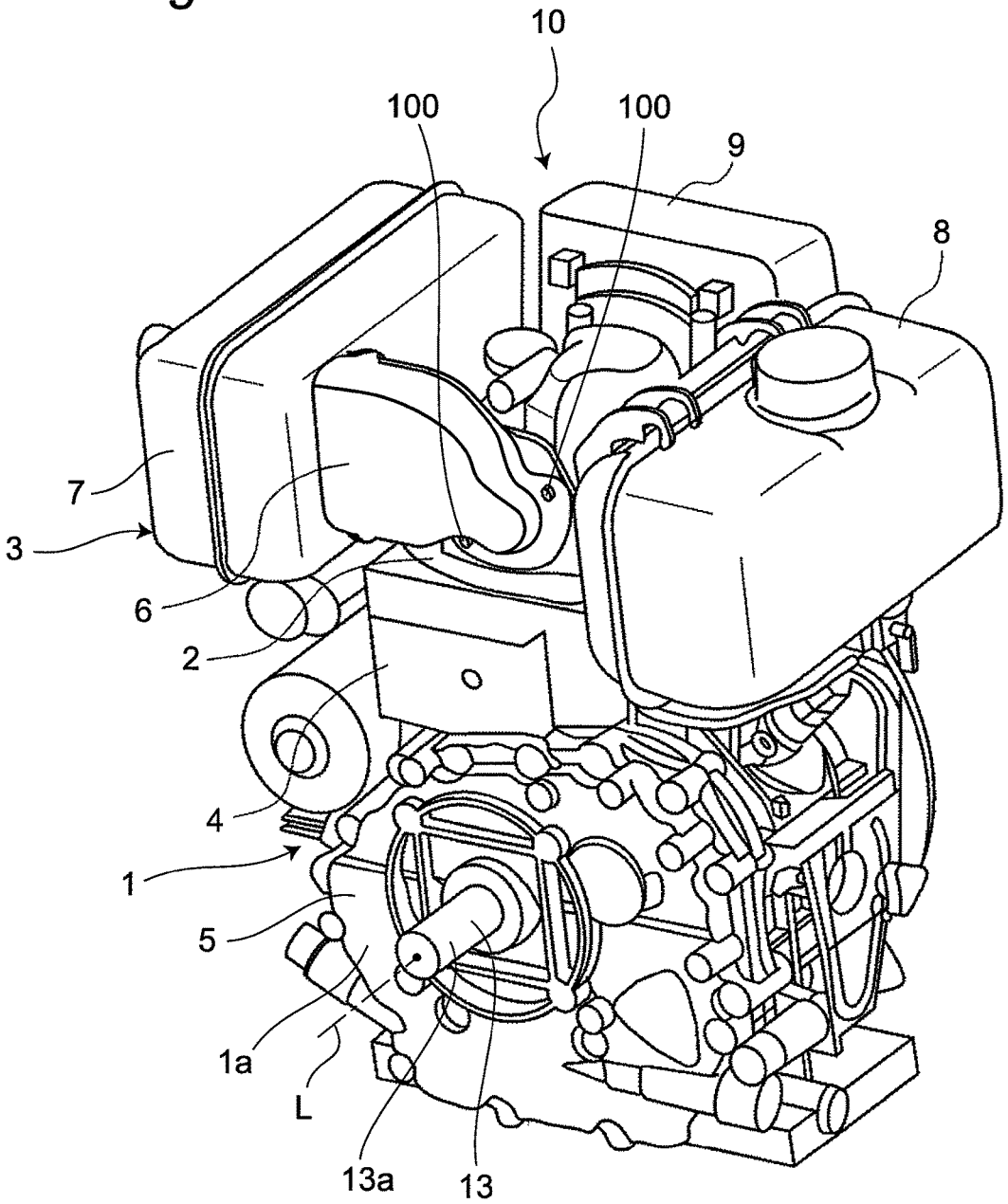
FIG. 1 is a perspective view showing an engine of a first embodiment of the present disclosure.

FIG. 1 is a perspective view showing an engine of a first embodiment of the present disclosure. As shown in FIG. 1, the engine 10 is an air-cooled single cylinder diesel engine. The engine 10 has a cylinder block 1, a cylinder head 2, an exhaust duct 3, a fuel tank 8, and an air cleaner 9. The cylinder head 2 is fitted to an upper portion of the cylinder block 1, the cylinder head 2 being fitted with the exhaust duct 3, the fuel tank 8, and the air cleaner 9.

Figure 2:
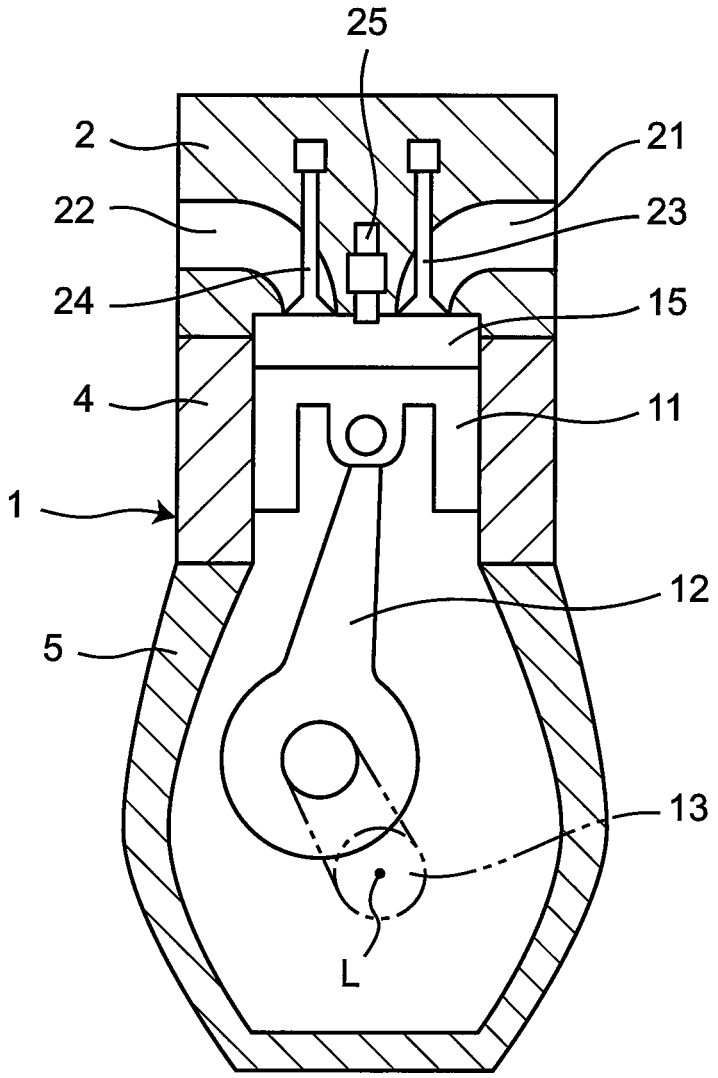
FIG. 2 is a simplified sectional view of a cylinder block and a cylinder head.

FIG. 2 is a simplified sectional view of the cylinder block 1 and the cylinder head 2. As shown in FIG. 2, the cylinder block 1 has a cylinder 4 and a crankcase 5 fitted to the cylinder 4. A piston 11 is reciprocably disposed within the cylinder 4. A crankshaft 13 is coupled via a con rod 12 to the piston 11. The crankshaft 13 is disposed within the crankcase 5.

The cylinder head 2 is fitted to the cylinder 4 of the cylinder block 1. A combustion chamber 15 is defined by a space enclosed by the cylinder head 2, an inner surface of the cylinder 4, and the piston 11. The cylinder head 2 has an intake port 21 and an exhaust port 22. The intake port 21 and the exhaust port 22 communicate with the interior (the combustion chamber 15) of the cylinder 4. The intake port 21 communicates with the air cleaner 9 (see FIG. 1). The exhaust port 22 communicates with the exhaust duct 3 (see FIG. 1).

The intake port 21 includes an intake valve 23 that opens or closes between the intake port 21 and the combustion chamber 15. The exhaust port 22 includes an exhaust valve 24 that opens or closes between the exhaust port 22 and the combustion chamber 15.

The cylinder head 2 includes a fuel injection nozzle 25 for injecting fuel into the combustion chamber 15. The fuel injection nozzle 25 communicates with the fuel tank 8 (see FIG. 1).

As shown in FIGS. 1 and 2, the cylinder block 1 has a load-side end face 1*a* from which an end 13*a* on the load side of the crankshaft 13 protrudes. A load member not shown (such as a fluid pressure pump or a pulley) is connected to the load-side end 13*a* of the crankshaft 13. A cooling fan not shown is connected to an end opposite to the load-side end 13*a* of the crankshaft 13.

The exhaust duct 3 has a catalyst storage case 6 and an exhaust muffler 7. The catalyst storage case 6 is fitted to the cylinder head 2 and communicates with the exhaust port 22 of the cylinder head 2. The catalyst storage case 6 is disposed toward the load-side end face 1*a* of the cylinder block 1. The exhaust muffler 7 communicates with the catalyst storage case 6.

In the engine configured as above, air in the atmosphere is supplied, through the air cleaner 9, from the intake port 21 of the cylinder head 2 into the combustion chamber 15, while diesel fuel in the fuel tank 8 is fed from the fuel injection nozzle 25 into the combustion chamber 15 so that diesel fuel is combusted in the combustion chamber 15. This allows the piston 11 to move so that the crankshaft 13 turns around a shaft center L, driving the load member connected to the load-side end 13*a* of the crankshaft 13. High temperature exhaust gas in the combustion chamber 15 is discharged from the exhaust port 22 of the cylinder head 2 through the catalyst storage case 6 and the exhaust muffler 7, in the mentioned order, into the atmosphere while lowering the temperature.

Figure 3:
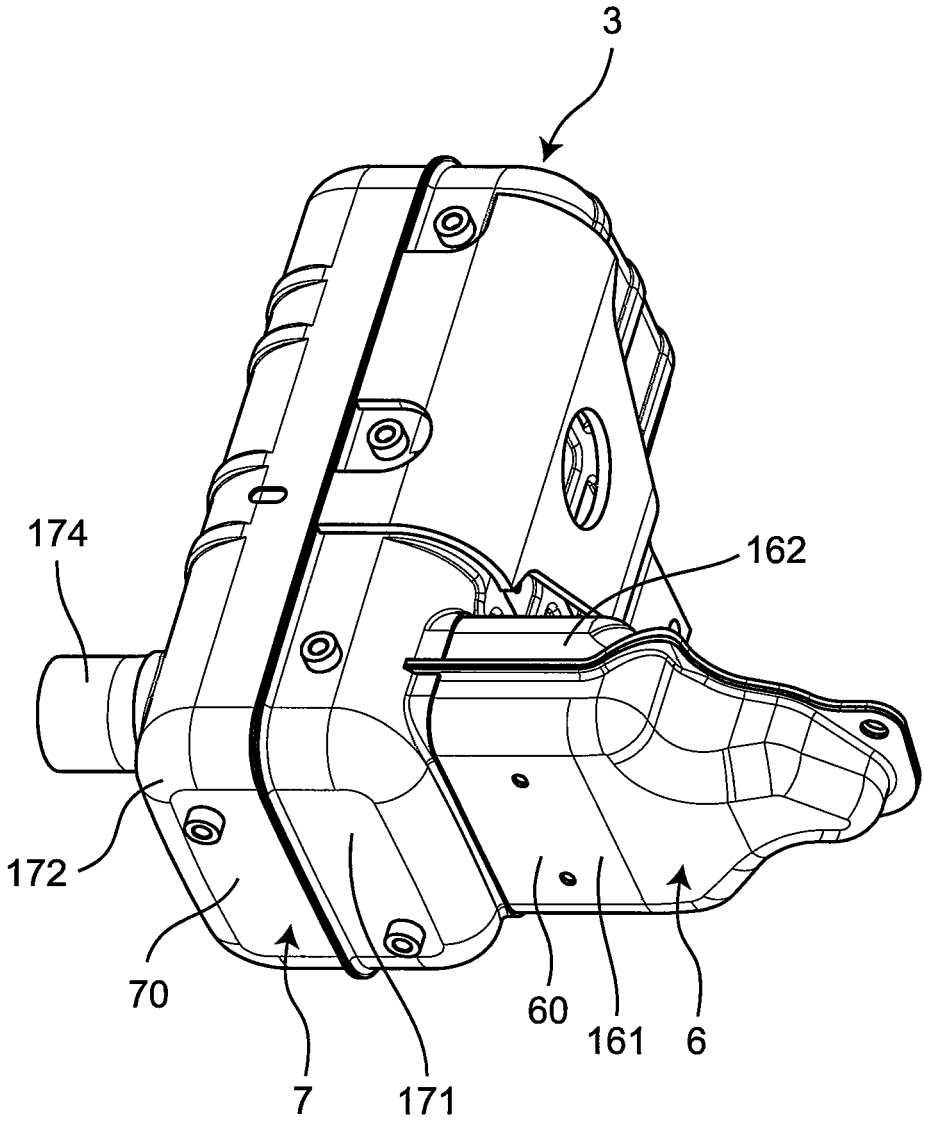
FIG. 3 is a perspective view of an exhaust duct.

FIG. 3 is a perspective view of the exhaust duct 3. As shown in FIG. 3, the catalyst storage case 6 and the exhaust muffler 7 are integrally connected to each other. That is, a case body 60 of the catalyst storage case 6 and a case body 70 of the exhaust muffler 7 are integrated.

Figure 4A:
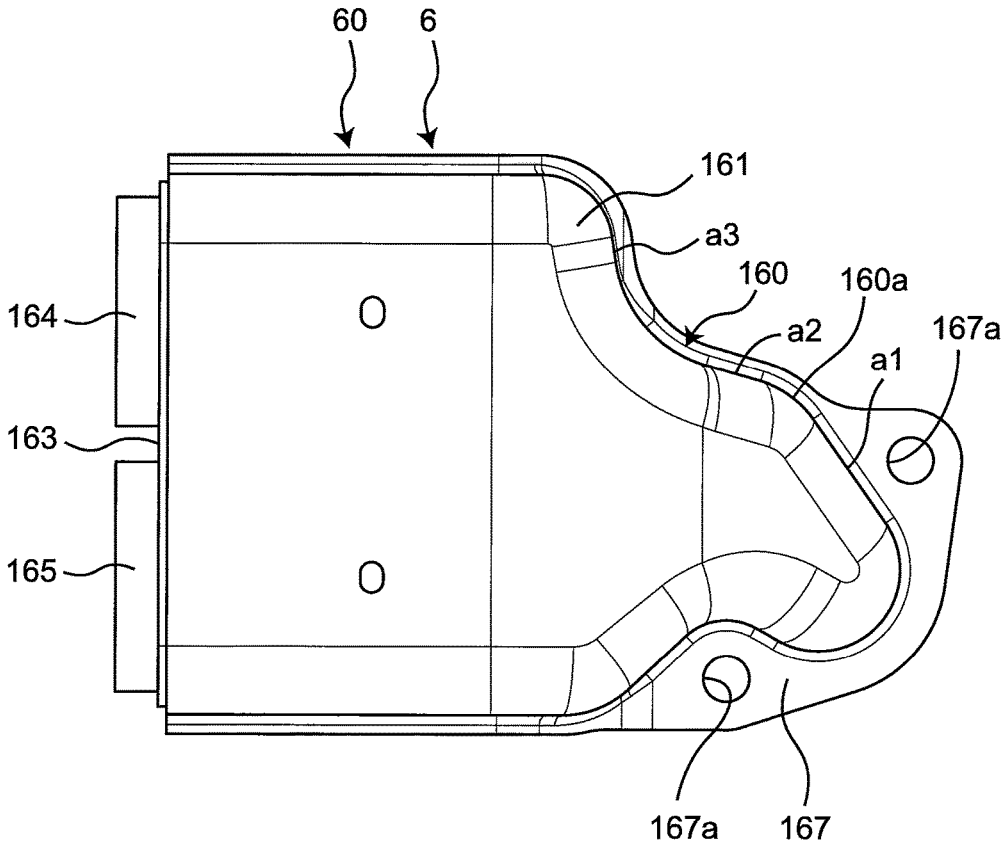
FIG. 4A is a front view of a catalyst storage case.
Figure 4B:
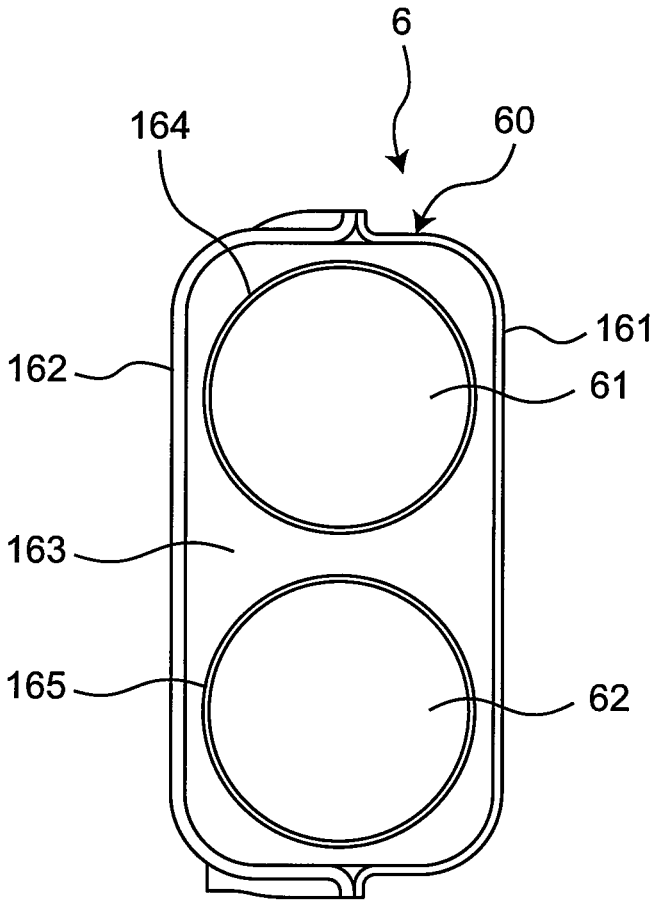
FIG. 4B is a left side view of the catalyst storage case.
Figure 4C:
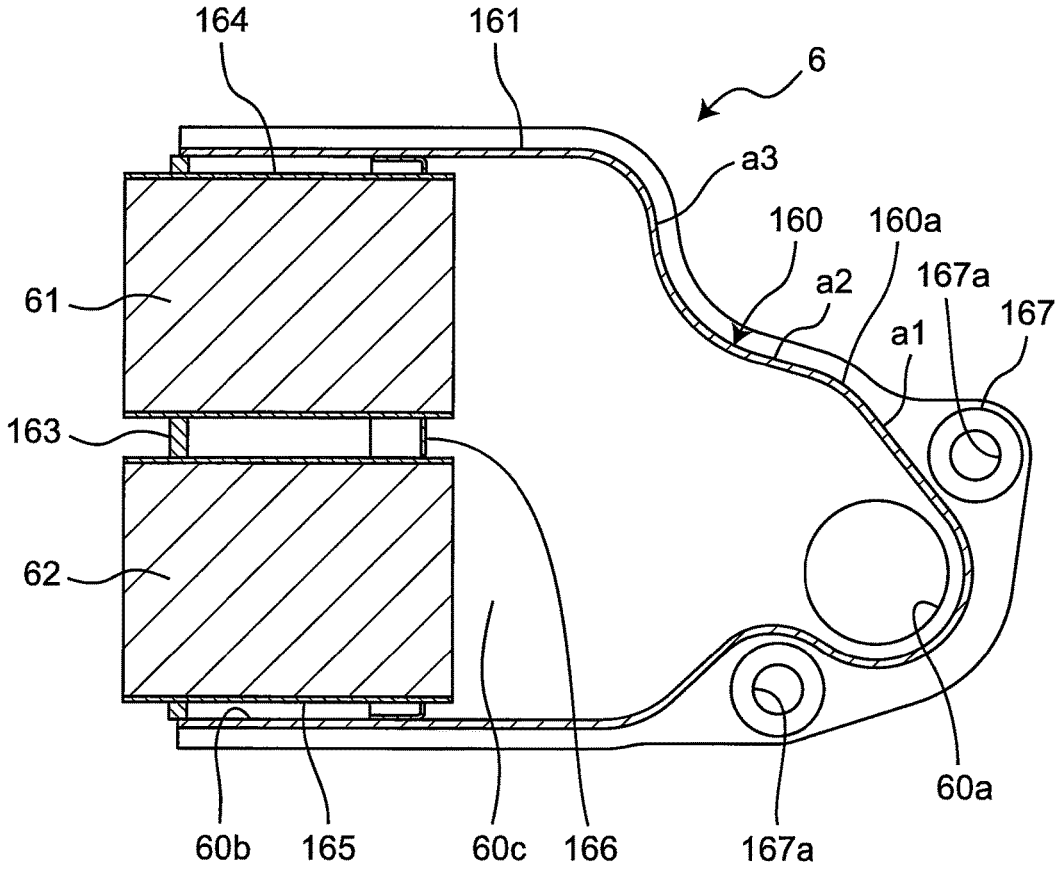
FIG. 4C is a sectional view of the catalyst storage case, as seen from the front.

FIG. 4A is a front view of the catalyst storage case 6. FIG. 4B is a left side view of the catalyst storage case 6. FIG. 4C is a sectional view of the catalyst storage case 6, as seen from the front. As shown in FIGS. 4A, 4B, and 4C, the catalyst storage case 6 has the case body 60 and two, first and second oxidation catalysts 61 and 62.

The case body 60 has an inlet 60*a*, an outlet 60*b*, and an exhaust passage 60*c* extending from the inlet 60*a* to the outlet 60*b* for allowing exhaust gas to pass therethrough. The inlet 60*a* communicates with the exhaust port 22 of the cylinder head 2. The outlet 60*b* communicates with the exhaust muffler 7.

The case body 60 has a first half 161 and a second half 162. The first half 161 and the second half 162 are joined together by welding. The first half 161 has a flange 167 toward the inlet 60*a*. The flange 167 has a hole 167*a*. A bolt 100 shown in FIG. 1 is inserted into the hole 167*a*. Thus, the case body 60 is fixed by the bolt 100 to the cylinder head 2. The inlet 60*a* of the case body 60 is connected via a seal member to the exhaust port 22 of the cylinder head 2.

An end plate 163 is fitted to the outlet 60*b* of the case body 60. The end plate 163 is fitted with a first tubular part 164 and a second tubular part 165 that pass therethrough. Portions toward the inlet 60*a* of the first and second tubular parts 164 and 165 are supported by a support plate 166. The support plate 166 is fitted to the interior of the case body 60. This allows the inside and the outside of the case body 60 to communicate with each other via the first and second tubular parts 164 and 165.

The first and the second tubular parts 164 and 165 are arrayed in a direction intersecting the direction along which the exhaust passage 60*c* extends. Describing specifically, the direction of array of the first and second tubular parts 164 and 165 is orthogonal to the direction of extension of the exhaust passage 60*c*.

A portion 160 of the case body 60 between the inlet 60*a* and the support plate 166 is formed in a flared manner such that the exhaust passage 60*c* flares from the inlet 60*a* toward the support plate 166. The flared portion 160 is formed so as to introduce exhaust gas into the first and second tubular parts 164 and 165. An upper wall 160*a* of the flared portion 160 includes three inclined surfaces a1, a2, and a3 each having a different inclination.

The first and the second oxidation catalysts 61 and 62 are arranged in the exhaust passage 60*c*. That is, the first oxidation catalyst 61 is inserted into the first tubular part 164, while the second oxidation catalyst 62 is inserted into the second tubular part 165.

The first and the second oxidation catalysts 61 and 62 are arrayed in a direction intersecting the direction along which the execute passage 60*c* extends. Describing specifically, the direction of array of the first and second oxidation catalysts 61 and 62 is orthogonal to the direction of extension of the exhaust passage 60*c*. To further describe, the first and second oxidation catalysts 61 and 62 are arrayed in a direction orthogonal to the shaft center L (see FIG. 1) of the crankshaft 13. That is, the shaft center L of the crankshaft 13 extends in a direction orthogonal to the plane of FIG. 4C, while the first and second oxidation catalysts 61 and 62 are arrayed vertically on the plane of FIG. 4C.

The first and the second oxidation catalysts 61 and 62 are of a flattened cylindrical shape. The first and second oxidation catalysts 61 and 62 are monolith carriers made of ceramic such as cordierite and have, to increase its specific surface area, a polygonal section partitioned by lattice-shaped or honeycomb-shaped porous partition walls. These partitions walls include a multiplicity of through holes formed in parallel to each other with exhaust gas entrances and exits alternately sealed. The partition walls carry catalyst metal such as platinum to thereby exhibit an oxidation catalytic function.

Although cordierite is used as the material of the monolith carrier, silicon carbide or stainless steel may be used without being limited thereto. The catalyst body may have a structure for increasing the specific surface area, and, for example, it may be a mesh ring including a plurality of lattice-shaped metal partition plates arranged therein. Although platinum is used as the catalyst metal, palladium, rhodium, iridium, etc. may be used without being limited thereto.

The first and the second oxidation catalysts 61 and 62 capture PM (suspended particulate matter) in exhaust gas by the porous partition walls. The first and second oxidation catalysts 61 and 62 impart an oxidizing power to nitrogen oxide (NOx), nitrogen monoxide (NO), carbon monoxide (CO), hydrocarbon (HC), etc. in exhaust gas by carrying of the catalyst metal, to generate carbon dioxide, water, nitrogen dioxide NO2, etc. The oxidizing power of large amounts of NO2, etc. generated in exhaust gas by the catalyst metal and high temperature of exhaust gas in the vicinity of the exhaust port 22 are utilized to continuously oxidize the collected PM, for combustion and removal.

Figure 5:
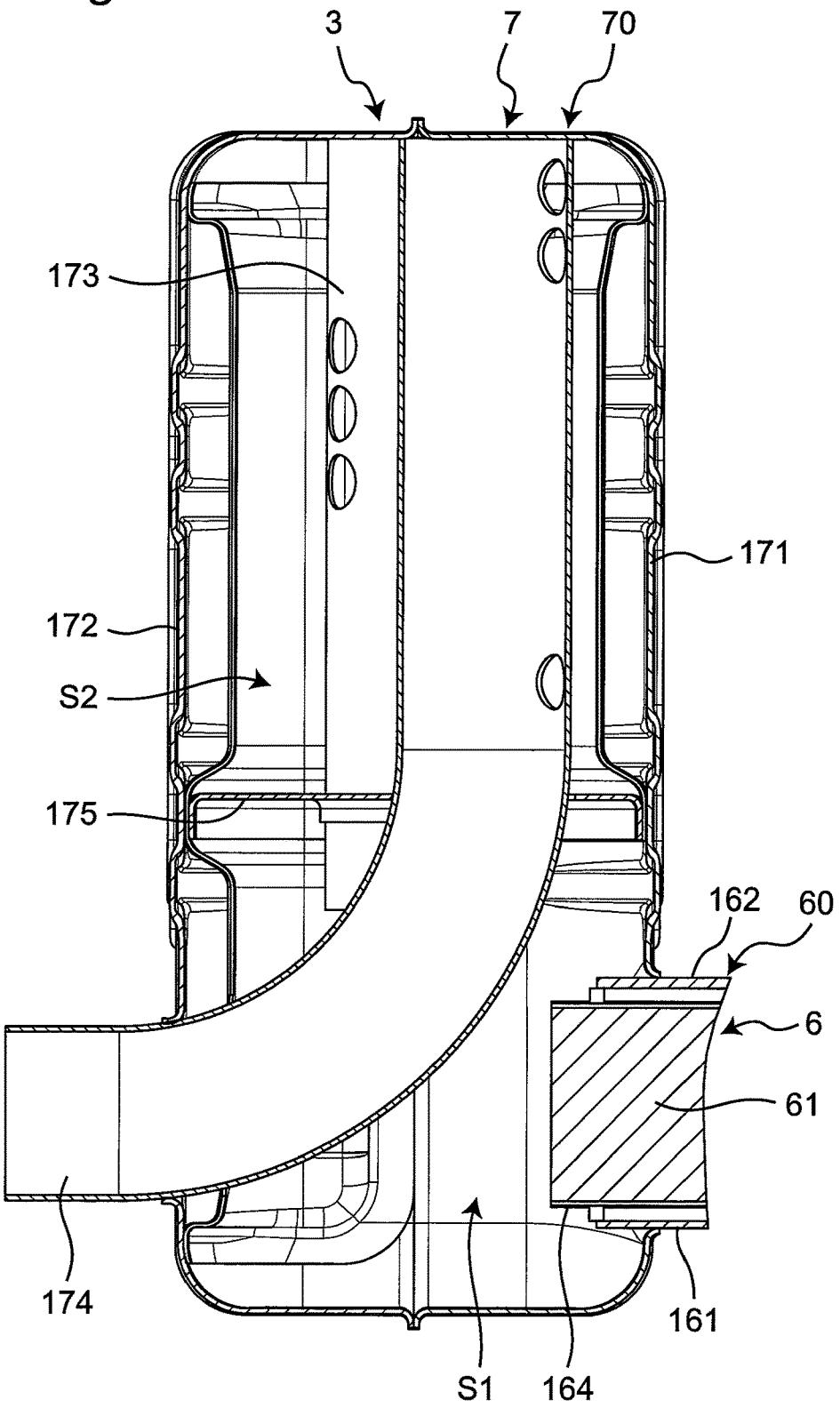
FIG. 5 is a sectional view of the exhaust duct, as seen from the plane.

FIG. 5 is a sectional view of the exhaust duct 3, as seen from the plane. As shown in FIG. 5, the case body 70 of the exhaust muffler 7 has a first half 171 and a second half 172. The first half 171 and the second half 172 are joined together by welding.

The case body 60 of the catalyst storage case 6 is fitted to the first half 171 in a penetrating manner. That is, the first half 171 and the case body 60 are integrally connected together by welding. The first half 171 and the case body 60 may be integrally connected together by bolts.

An internal pipe 173 and a discharge pipe 174 are arranged within the interior of the case body 70 of the exhaust muffler 7. The interior of the case body 70 is partitioned by a partition plate 175 into a first space S1 and a second space S2. The case body 60 (first and second oxidation catalysts 61 and 62) enters the first space S1. The internal pipe 173 extends through the partition plate 175 to allow the first space S1 and the second space S2 to communicate with each other. The discharge pipe 174 extends through the partition plate 175 and the second half 172 to allow the second space S2 and the exterior of the case body 70 to communicate with each other.

Thus, exhaust gas passing through the first and the second oxidation catalysts 61 and 62 enters the first space S1 and thereafter passes through the internal pipe, entering the second space S2. Afterward, exhaust gas flows from the second space S2 through the discharge pipe 174, being discharged to the outside of the case body 70.

According to the catalyst storage case 6 configured as above, the first and the second oxidation catalysts 61 and 62 are contained and are arrayed in a direction intersecting the direction along which the exhaust passage 60*c* extends. As a result, even though the flow of exhaust gas becomes uneven within the case body 60, at least one of the first and second oxidation catalysts 61 and 62 experiences clogging. Hence, if clogging occurs in only the second oxidation catalyst 62, only the clogged second oxidation catalyst 62 may be replaced and the unclogged first oxidation catalyst 61 may be used intactly, thus enabling the waste of the oxidation catalysts 61 and 62 to be reduced.

According to the exhaust duct 3 configured as above, the catalyst storage case 6 and the exhaust muffler 7 are integrally connected to each other, with the result that the number of components of the exhaust duct 3 can be reduced, facilitating the assembly of the exhaust duct 3.

According to the engine 10 configured as above, due to including the catalyst storage case 6 having the first and the second oxidation catalysts 61 and 62, even though the oxidation catalysts 61 and 62 are subjected to clogging by exhaust gas as a result of the operation of the engine 10, the waste of the oxidation catalysts 61 and 62 can be reduced when replacing the oxidation catalysts 61 and 62.

Since the first and the second oxidation catalysts 61 and 62 are arrayed in a direction intersecting the shaft center L of the crankshaft 13, the thickness of the catalyst storage case 6 in the direction of the shaft center L of the crankshaft 13 can be suppressed regardless of the presence of the two oxidation catalysts 61 and 62. Therefore, the catalyst storage case 6 can be restrained from protruding toward the load of the cylinder block 1, preventing the catalyst storage case 6 from interfering with the load member when connecting the load member to the load-side end 13*a* of the crankshaft 13 of the cylinder block 1. In particular, since the first and second oxidation catalysts 61 and 62 are arrayed in a direction orthogonal to the shaft center L of the crankshaft 13, the first and second oxidation catalysts 61 and 62 cannot be arrayed along the shaft center L of the crankshaft 13, thus enabling the thickness of the catalyst storage case 6 in the direction of the shaft center L of the crankshaft 13 to be further suppressed.

Second Embodiment

Figure 6:
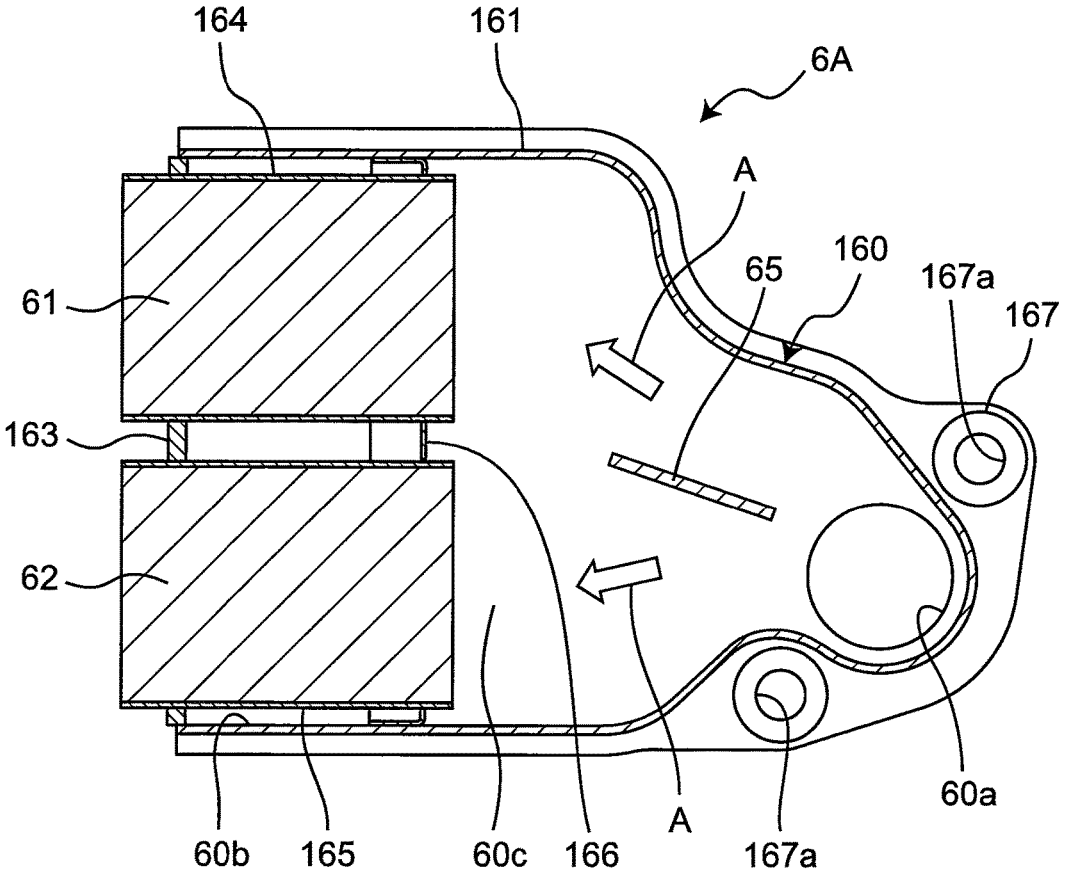
FIG. 6 is a sectional view showing a catalyst storage case of a second embodiment of the present disclosure.

FIG. 6 is a sectional view showing a catalyst storage case of a second embodiment of the present disclosure. The second embodiment differs from the first embodiment only in the configuration of a baffle plate. Only this different configuration will be described below. In the second embodiment, the same reference numerals as those in the first embodiment denote the same configurations as those in the first embodiment and therefore will not again be described.

As shown in FIG. 6, a catalyst storage case 6A of the second embodiment has a baffle plate 65. In the exhaust passage 60*c*, the baffle plate 65 is disposed between the first and second oxidation catalysts 61, 62 and the inlet 60*a*. That is, the baffle plate 65 is disposed in the flared portion 160 of the case body 60.

As indicated by hollow arrows A of FIG. 6, the baffle plate 65 leads exhaust gas to each of the first and second oxidation catalysts 61 and 62. The baffle plate 65 is disposed so as to substantially uniformly lead exhaust gas to each of the oxidation catalysts 61 and 62. Describing specifically, the baffle plate 65 is disposed on a plane extending between the first and second oxidation catalysts 61 and 62 and through the center of the inlet 60*a*.

According to the catalyst storage case 6A configured as above, since the baffle plate 65 leads exhaust gas to each of the oxidation catalysts 61 and 62, it can substantially uniformly lead exhaust gas to each of the oxidation catalysts 61 and 62 so that the unevenness of occurrence of clogging in the first and second oxidation catalysts 61 and 62 can be reduced.

Third Embodiment

Figure 7:
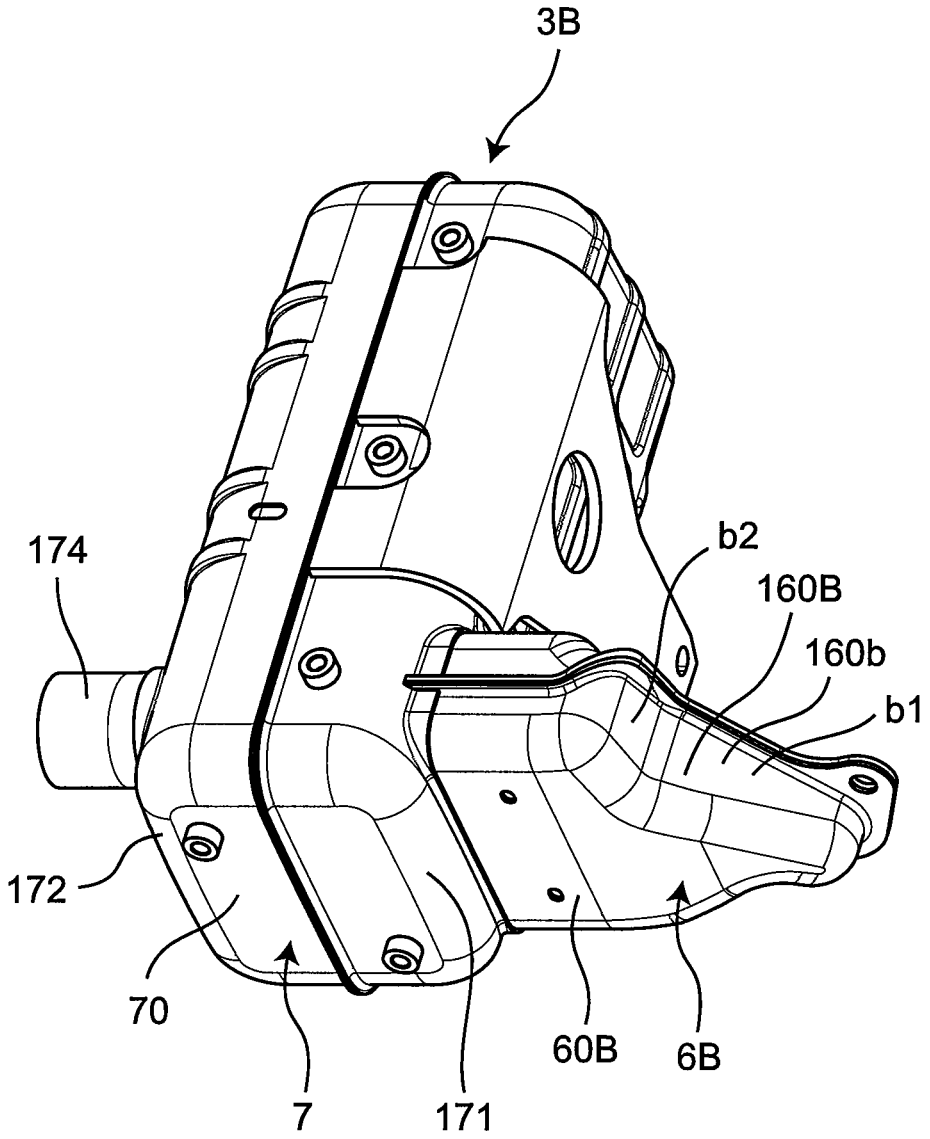
FIG. 7 is a perspective view showing an exhaust duct of a third embodiment of the present disclosure.

FIG. 7 is a perspective view showing an exhaust duct of a third embodiment of the present disclosure. The third embodiment differs from the first embodiment only in the configuration of the catalyst storage case of the exhaust duct. Only this different configuration will be described below. In the third embodiment, the same reference numerals as those in the first embodiment denote the same configurations as those in the first embodiment and therefore will not again be described.

As shown in FIG. 7, a catalyst storage case 6B of an exhaust duct 3B differs from the catalyst storage case 6 of the first embodiment (FIG. 4A) in the shape of a flared portion 160B of a case body 60B. Although the upper wall 160*a* of the flared portion 160 of the first embodiment (FIG. 4A) includes three inclined surfaces a1, a2, and a3 each having a different inclination, an upper wall 160*b* of the flared portion 160B of the third embodiment (FIG. 7) includes two inclined surfaces b1 and b2 each having a different inclination. The upstream inclined surface b1 of FIG. 7 corresponds to the two upstream inclined surfaces a1 and a2 of FIG. 4A, while the downstream inclined surface b2 of FIG. 7 corresponds to the downstream inclined surface a3 of FIG. 4A.

The present disclosure is not limited to the above embodiments and could be modified in design without departing from the spirit of the present disclosure. For example, the respective features of the first to the third embodiments may variously be combined.

Although the single cylinder diesel engine is used as the engine in the above embodiments, a multicylinder diesel engine may be used.

Although the two oxidation catalysts are disposed in the above embodiments, three or more oxidation catalysts may be disposed.

Although the two oxidation catalysts are arrayed in a direction orthogonal to the direction along which the exhaust passage extends in the above embodiments, they may be arrayed in a direction intersecting at a predetermined angle, instead of a right angle, with the direction of extension of the exhaust passage.

Although the two oxidation catalysts are arrayed in a direction orthogonal to the shaft center of the crankshaft in the above embodiments, they may be arrayed in a direction intersecting at a predetermined angle, instead of a right angle, with the shaft center of the crankshaft.

Although the catalyst storage case and the exhaust muffler are integrally connected together by welding in the above embodiments, the catalyst storage case (case body) and the exhaust muffler (case body) may be integrally seamlessly continuously connected together by pressing a single metal plate.

EXPLANATIONS OF LETTERS OR NUMERALS

1 cylinder block
1*a* load-side end face
2 cylinder head
3, 3B exhaust duct
4 cylinder
5 crankcase
6, 6A, 6B catalyst storage case
7 exhaust muffler
10 engine
11 piston
13 crankshaft
13*a* load-side end
15 combustion chamber
21 intake port
22 exhaust port
60, 60B case body
60*a* inlet
60*b* outlet
60*c* exhaust passage
61 first oxidation catalyst
62 second oxidation catalyst
65 baffle plate
70 case body
L shaft center of crankshaft

The invention claimed is:

1. An engine comprising:
a cylinder block having a cylinder;
a cylinder head attached to the cylinder block, the cylinder head having an exhaust port communicating with an interior of the cylinder; and
a catalyst storage case attached to the cylinder head, wherein the catalyst storage case comprises:
a case body having an inlet, an outlet, and an exhaust passage extending from the inlet to the outlet for allowing exhaust gas to pass therethrough; and
a plurality of oxidation catalysts disposed in the exhaust passage of the case body, wherein
the plurality of oxidation catalysts are arrayed in a direction intersecting a direction along which the exhaust passage extends,
the inlet of the catalyst storage case is in communication with the exhaust port of the cylinder head,
the cylinder block has a piston disposed in the cylinder and a crankshaft coupled to the piston,
the cylinder block has a load-side end face from which a load-side end of the crankshaft protrudes,
the catalyst storage case is disposed toward the load-side end face of the cylinder block, and
the plurality of oxidation catalysts in the catalyst storage case are arrayed in a direction intersecting a shaft center of the crankshaft.

2. The engine according to claim 1, wherein the catalyst storage case further comprises:
a baffle plate disposed between the plurality of oxidation catalysts and the inlet in the exhaust passage of the case body for leading exhaust gas to each of the plurality of oxidation catalysts.

* * * * *